US006019494A

United States Patent [19]

Lee

[11] Patent Number: 6,019,494

[45] Date of Patent: Feb. 1, 2000

[54] MOUNTING DEVICE FOR A DECORATIVE STRING OF LIGHTS

[76] Inventor: Eugene Lee, 7th FL., #50, Alley 1, Lane 131, Yen-Chi St., Taipei, Taiwan

[21] Appl. No.: 09/012,721

[22] Filed: Jan. 23, 1998

[51] Int. Cl.[7] ..... F21S 3/14

[52] U.S. Cl. ..... 362/807; 362/121; 362/249; 362/227

[58] Field of Search ..... 362/121, 252, 362/806–808, 812, 227, 236, 238, 240, 249, 297, 298, 302, 304, 310

[56] References Cited

U.S. PATENT DOCUMENTS

| | | | |
|---|---|---|---|
| 4,783,726 | 11/1988 | Wang | 362/252 |
| 5,416,678 | 5/1995 | Schabowski | 362/249 |
| 5,421,290 | 6/1995 | Welch | 119/51.11 |
| 5,441,257 | 8/1995 | Sheaffer | 273/32 |
| 5,526,243 | 6/1996 | Masters | 362/122 |

*Primary Examiner*—Sandra O'Shea
*Assistant Examiner*—Ismael Negron
*Attorney, Agent, or Firm*—Raymond Y. Chan; David and Raymond

[57] ABSTRACT

A mounting device for supporting a decorative string of the type including a conducting cord, a plurality of bulb sockets connected in series by the conducting cord and a plurality of bulbs respectively mounted in the bulb sockets, the mounting device including two symmetrical cover shells covered on and fixedly fastened to each other to hold the bulb sockets, the conducting cord and the bulbs on the inside, two mounting tubes at one side, and two anchoring devices detachably connected to the mounting tubes for fastening to the ground, the cover shells having each sets of locating rods symmetrically disposed at two opposite sides and respectively clamped on the periphery of the bulb sockets at two sides to hold down the bulb sockets in position, and a plurality of through holes through which light from the bulbs pass to the outside.

14 Claims, 6 Drawing Sheets

MOUNTING DEVICE FOR A DECORATIVE STRING OF LIGHTS

BACKGROUND OF THE INVENTION

The present invention relates to a mounting device for supporting a decorative string of lights or Christmas tree light set, and more particularly to such a mounting device which is comprised of two symmetrical cover shells covered on each other to hold a decorative string on the inside, enabling bulb sockets of the decorative string to be firmly secured in position and light from bulbs of the decorative string to pass to the outside through through holes on both cover shells.

A variety of mounting devices have been disclosed for releasably supporting a decorative string or Christmas tree light set. These mounting devices commonly include a platen-like base frame for releasably supporting the bulb sockets of the decorative string. The platen-like base frame may have any of a variety of designs. When the decorative string is installed, the bulb sockets are arranged to show a pattern. These mounting devices have drawbacks. Because the bulb sockets with the installed bulbs are exposed to the outside, the bulbs, the bulb sockets and the conducting cord tend to be damaged, or forced to drop from the base frame.

SUMMARY OF THE INVENTION

The present invention has been accomplished to provide a mounting device for a decorative string of lights which eliminates the aforesaid problems. According to one aspect of the present invention, the mounting device comprises two symmetrical cover shells covered on and fixedly fastened to each each other to hold the bulb sockets, the conducting cord and the bulbs on the inside, the cover shells having each sets of locating rods symmetrically disposed at two opposite sides and respectively clamped on the periphery of the bulb sockets at two sides to hold down the bulb sockets in position, and a plurality of through holes through which light from the bulbs pass to the outside. According to another aspect of the present invention, two mounting tubes provided at one side of the mounting device, and two anchoring devices are detachably connected to the mounting tubes for fastening to the ground.

BRIEF DESCRIPTION OF THE DRAWINGS

FIG. 2-1 is a top plain view showing the assembly of FIG. 1 assembled.

FIG. 2-2 is a sectional side view showing the assembly of FIG. 1 assembled.

DETAILED DESCRIPTION OF THE PREFERRED EMBODIMENT

Figure 1:
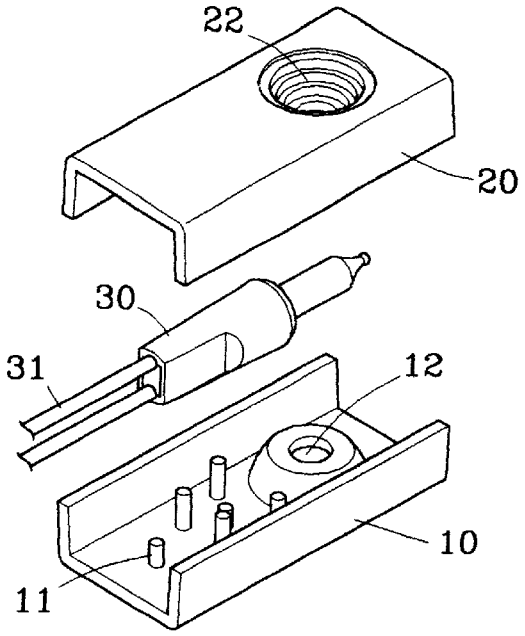
FIG. 1 is an exploded view of a part of a mounting device for a decorative string of lights according to the present invention.
Figures 1, 2:
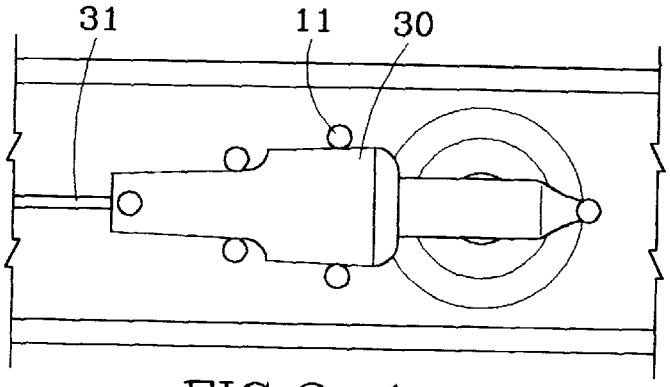
Figure 2:
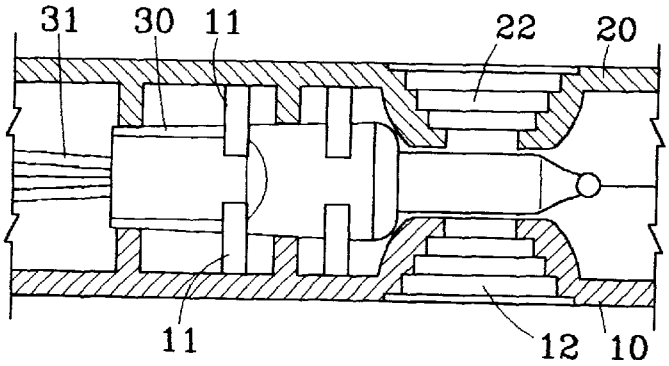

Referring to FIGS. 1 and 2-1, the first cover shell, referenced by 10, and the second cover shell, referenced by 20, are symmetrical, having each a plurality of locating rods 11 perpendicularly raised from the inside, and a through hole 12 or 22. The first cover shell 10 and the second cover shell 20 are covered on each other and form a casing to hold a bulb socket 30 on the inside. The bulb socket 30 holds a bulb, having lower and upper halves of the body thereof respectively secured to the first cover shell 10 and the second cover shell 20 by the respective locating rods 11, permitting the bulb to be retained in between the through holes 12;22 on the first cover shell 10 and the second cover shell 20. By forcing the locating rods 11 into engagement with the periphery of the bulb socket 30, the first cover shell 10 and the second cover shell 20 are secured together and closed on each other. When installed, the bulb socket 30 is firmly retained in place and prohibited from rotation, the lead wires 31 of the bulb socket rare received inside the cover shells 10;20, and light from the bulb on the bulb socket 30 passes to the outside through the through holes 12;22 on the first cover shell 10 and the second cover shell 20.

Referring to FIG. 2-2, the through holes 12;22 on the first cover shell 10 and the second cover shell 20 are stepped through holes that are made wider toward the outside. Through the stepped through holes 12;22 light passes from the bulb on the bulb socket 30 to the outside in reversed directions.

Figure 3:
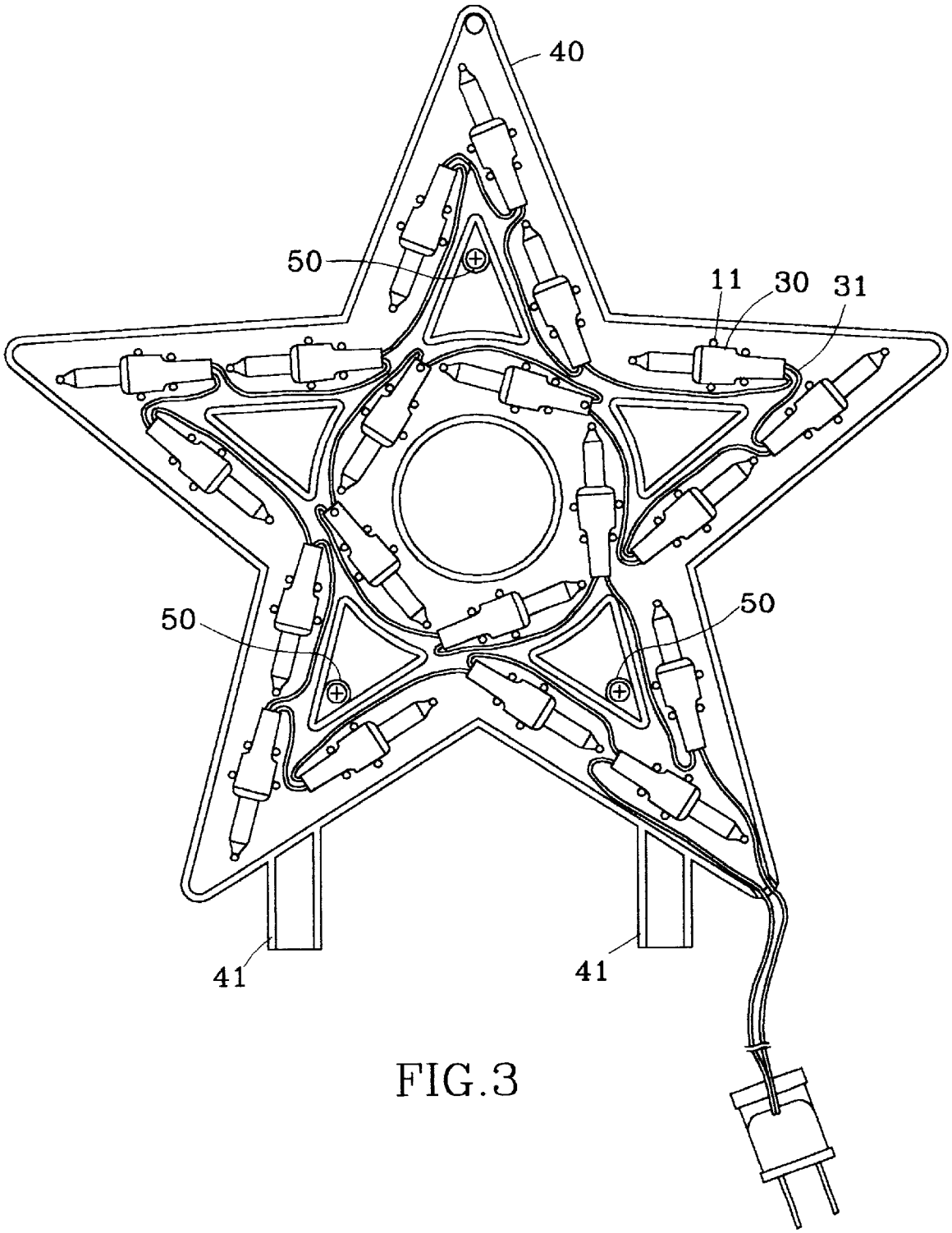
FIG. 3 is a front plain view of the mounting device according to the present invention (the anchoring devices excluded).
Figure 4:
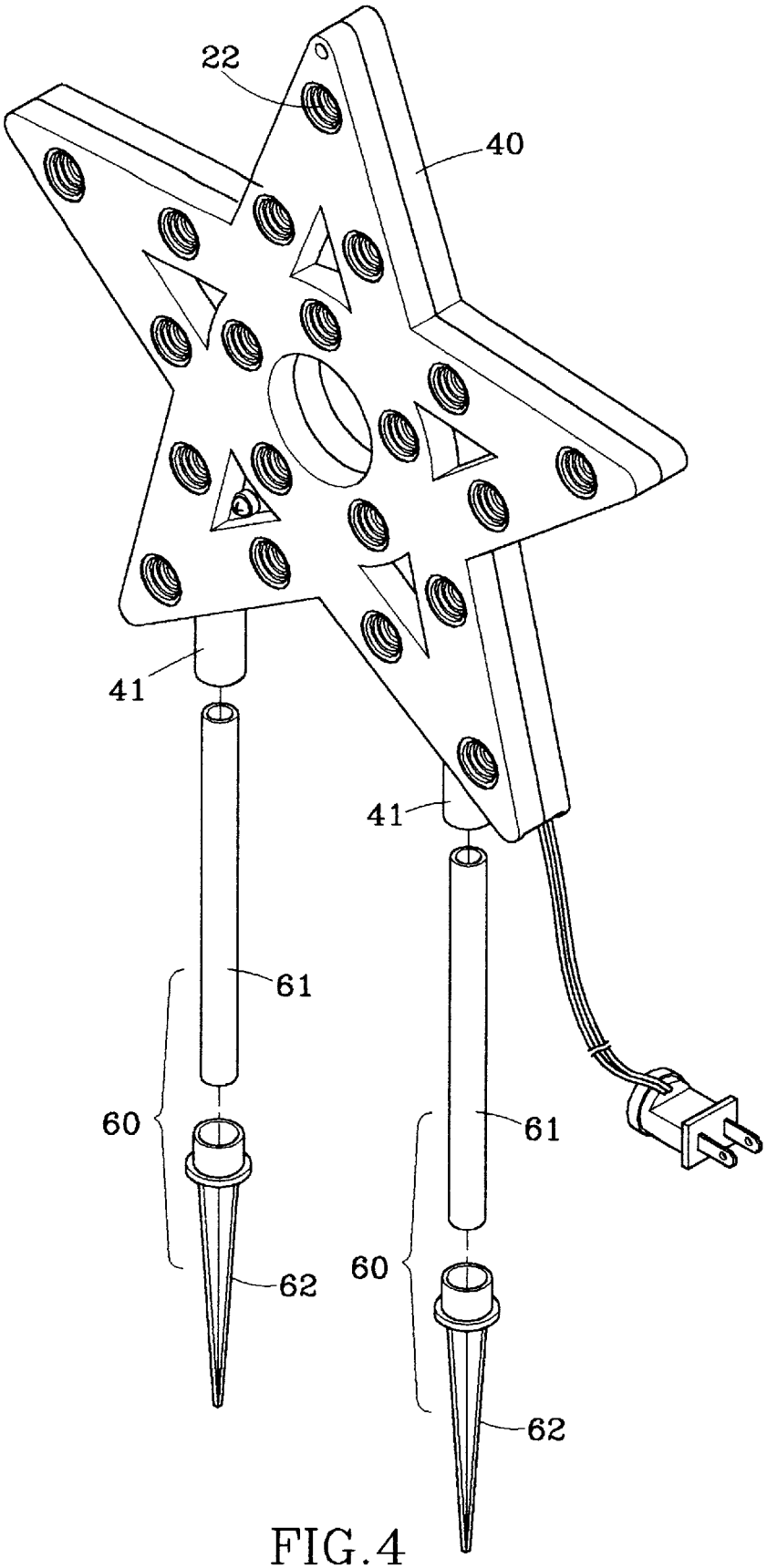
FIG. 4 is an exploded view of the present invention showing the relationship between the mounting tubes and the anchoring devices.
Figure 5:
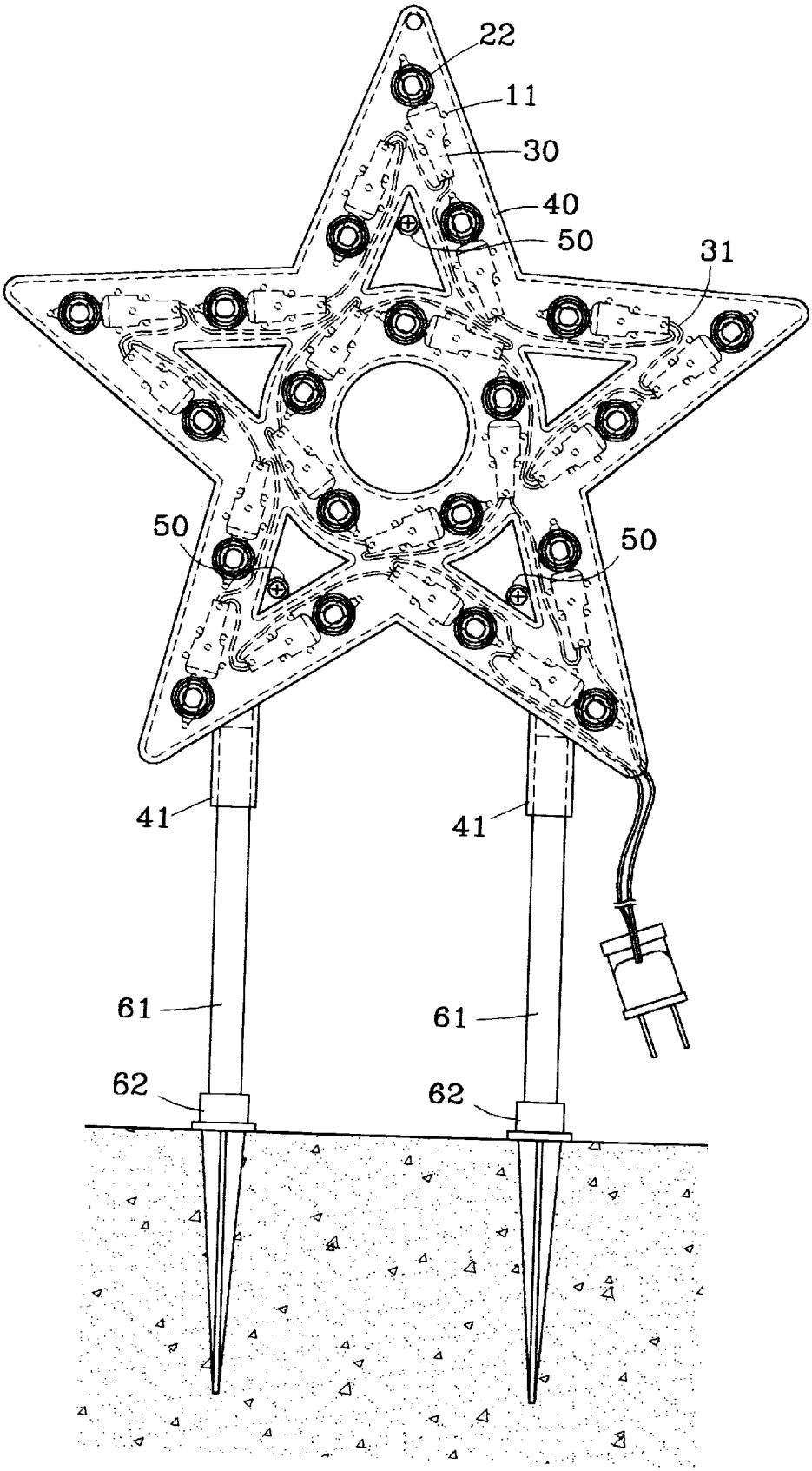
FIG. 5 is a sectional view showing the assembly of FIG. 4 installed in the ground.

Referring to FIGS. 3, 4 and 5, the mounting device 40 is shaped like a star and comprised of a first cover shell and a second cover shell covered on each other and fixedly secured together by screws 50 to hold a decorative string of lights on the inside, the bulb sockets 30 of the decorative string of lights are retained in the mounting device 40 by respective locating rods 11 between the first cover shell and the second cover shell of the mounting device 40. When the decorative string of lights is turned on, light from the bulbs on the bulb sockets 30 pass to the outside through the through holes 12;22 (11 is not shown) on the first cover shell and the second cover shell of the mounting device 40. Further, the mounting device 40 has two parallel mounting tubes 41 at one side. Two anchoring device 60 are connected to the mounting tubes 41 for securing the mounting device 40 to for example the ground. Each anchoring device 60 comprises a pointed tip member 62 for fastening to the ground, and a tubular connecting member 61 connected between the pointed tip member 62 and one mounting tube 41. FIG. 5 shows the pointed tip members 62 of the anchoring device 60 fastened to the ground, the mounting device 40 supported on the anchoring device 60.

Figure 6:
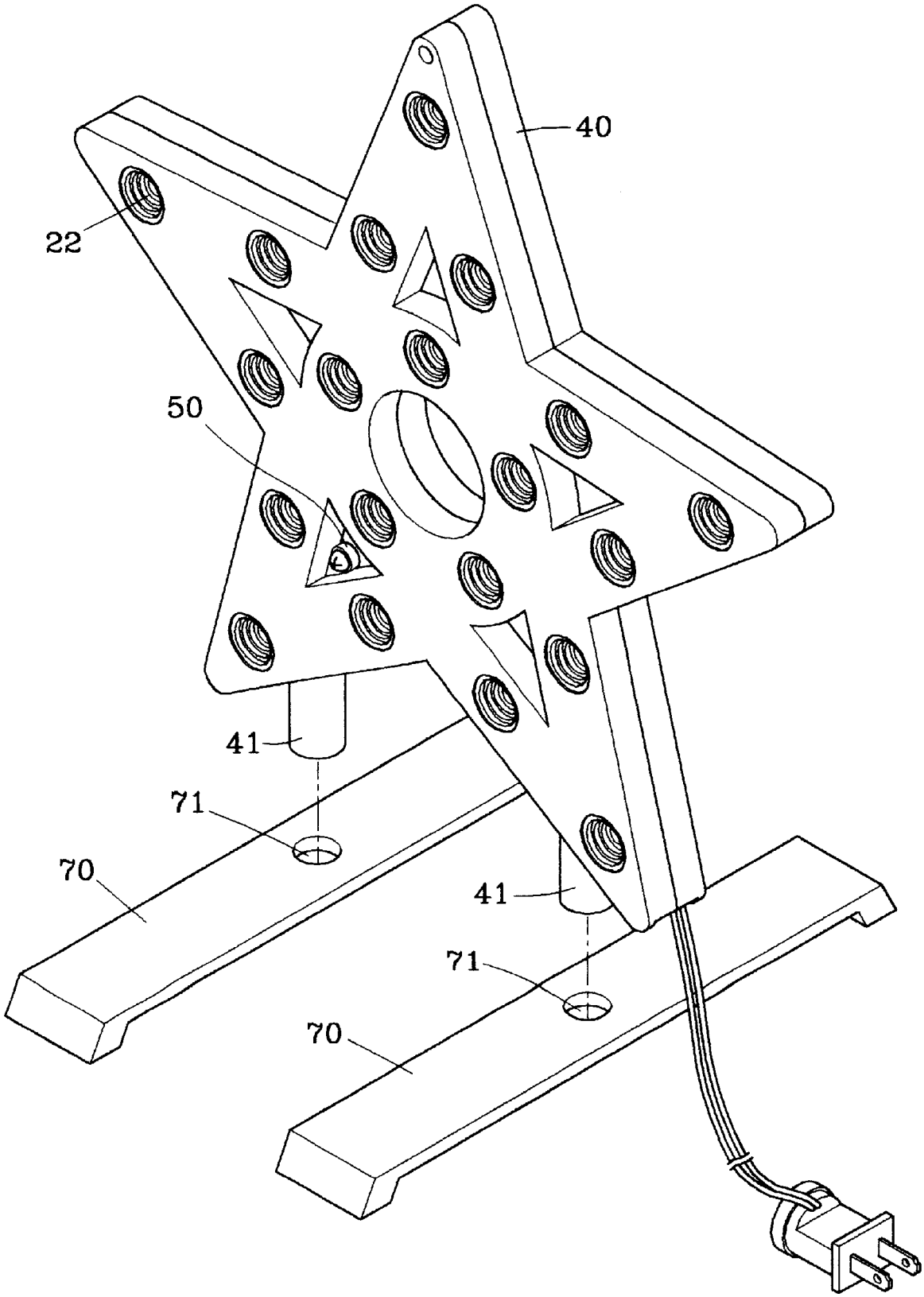
FIG. 6 shows another mounting example of the present invention.

Referring to FIG. 6, the mounting tubes 41 of the mounting device 40 may be fastened to a respective mounting hole 71 on a respective supporting plate 70, permitting the mounting device 40 two be supported on the two parallel supporting plates 70.

Figure 7:
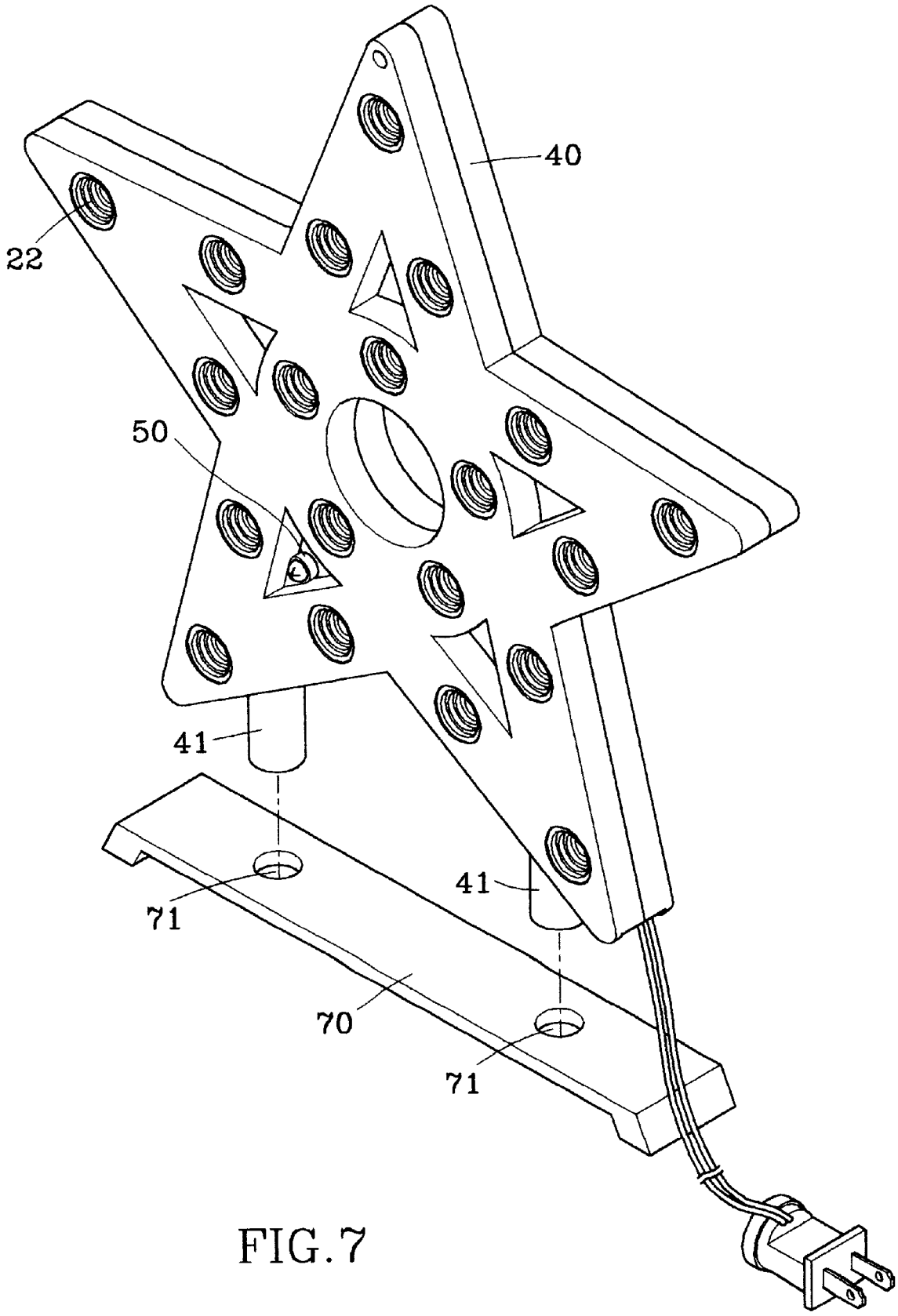
FIG. 7 shows still another mounting example of the present invention.

Referring to FIG. 7, the mounting tubes 41 of the mounting device 40 may be fastened to a respective mounting hole 71 on one supporting plate 70, permitting the mounting device 40 to be supported on the supporting plate 70.

It is to be understood that the drawings are designed for purposes of illustration only, and are not intended as a definition of the limits and scope of the invention disclosed.

What is claimed is:

1. A mounting device for supporting a decorative string of lights which comprises at least a conducting cord, a plurality of bulb sockets electrically connected by said conducting cord, and a plurality of bulbs respectively mounted in said bulb sockets, wherein said mounting device comprises a casing for receiving said bulb sockets, said bulbs and said conducting cord of said decorative string therein, said casing comprising a first cover shell and a second cover shell which are covered on each other to form said casing, said casing having a plurality of through holes thereon, said mounting device further comprising a locating means disposed inside said casing for holding said bulb sockets firmly in place inside said casing and permitting said bulbs mounted in said bulb sockets to be retained in place at said through holes respectively so as to enable light from said bulbs passing to outside through said through holes, wherein said locating means comprises a plurality of locating rods perpendicularly raised from said first cover shell and said second cover shell, for securing said bulb sockets between said first cover shell and said second cover shell and permitting each of said bulbs to be retained between respective pair of said through holes provided on said first cover shell and said second cover shell respectively, by forcing said locating rods into engagement with a periphery of each of said bulb sockets.

2. A mounting device for supporting a decorative string of lights, as recited in claim 1, wherein said first cover shell and said second cover shell are symmetrically in shape and structure, wherein said locating rods are disposed at two opposite sides of said first and second cover shells symmetrically so as to respectively clamp on the periphery of said bulb sockets at two sides to hold down said bulb sockets in position.

3. A mounting device for supporting a decorative string of lights, as recited in claim 2, wherein said mounting device is shaped like a star and said first and second cover shells are fixedly secured together by screws.

4. A mounting device for supporting a decorative string of lights, as recited in claim 1, wherein each of said through holes is a stepped hole.

5. A mounting device for supporting a decorative string of lights, as recited in claim 4, wherein said mounting device is shaped like a star and said first and second cover shells are fixedly secured together by screws.

6. A mounting device for supporting a decorative string of lights, as recited in claim 1, wherein said mounting device is shaped like a star and said first and second cover shells are fixedly secured together by screws.

7. A mounting device for supporting a decorative string of lights, as recited in claim 6, further comprising two parallel mounting tubes extended therefrom for mounting.

8. A mounting device for supporting a decorative string of lights, as recited in claim 7, further comprising two supporting plates for supporting said two mounting tubes respectively, each of said supporting plates having a respective mounting hole for mounting said respective mounting tube.

9. A mounting device for supporting a decorative string of lights, as recited in claim 7, further comprising a supporting plate has two mounting holes thereon for mounting said two supporting tubes respectively.

10. A mounting device for supporting a decorative string of lights, as recited in claim 7, further comprising two anchoring devices respectively connected to said two mounting tubes for fastening said mounting device to ground, each of said anchoring devices comprising a pointed tip member and a connecting tube connected between said pointed tip member and one of said mounting tubes.

11. A mounting device for supporting a decorative string of lights, as recited in claim 1, further comprising two parallel mounting tubes extended therefrom for mounting.

12. A mounting device for supporting a decorative string of lights, as recited in claim 11, further comprising two supporting plates for supporting said two mounting tubes respectively, each of said supporting plates having a respective mounting hole for mounting said respective mounting tube.

13. A mounting device for supporting a decorative string of lights, as recited in claim 11, further comprising a supporting plate has two mounting holes thereon for mounting said two supporting tubes respectively.

14. A mounting device for supporting a decorative string of lights, as recited in claim 11, further comprising two anchoring devices respectively connected to said two mounting tubes for fastening said mounting device to ground, each of said anchoring devices comprising a pointed tip member and a connecting tube connected between said pointed tip member and one of said mounting tubes.

* * * * *